US012703023B2

(12) United States Patent
Yaguchi et al.

(10) Patent No.: US 12,703,023 B2
(45) Date of Patent: Aug. 11, 2026

(54) APPARATUS OF MANUFACTURING INORGANIC MATERIAL AND METHOD OF MANUFACTURING INORGANIC MATERIAL

(71) Applicant: FURUKAWA CO., LTD., Tokyo (JP)

(72) Inventors: Yuichi Yaguchi, Tsukuba (JP); Yoshitaka Sakairi, Tsukuba (JP)

(73) Assignee: FURUKAWA CO., LTD., Tokyo (JP)

( * ) Notice: Subject to any disclaimer, the term of this patent is extended or adjusted under 35 U.S.C. 154(b) by 548 days.

(21) Appl. No.: 17/765,958

(22) PCT Filed: Aug. 18, 2020

(86) PCT No.: PCT/JP2020/031130
§ 371 (c)(1),
(2) Date: Apr. 1, 2022

(87) PCT Pub. No.: WO2021/065227
PCT Pub. Date: Apr. 8, 2021

(65) Prior Publication Data

US 2022/0339700 A1 Oct. 27, 2022

(30) Foreign Application Priority Data

Oct. 2, 2019 (JP) ..... 2019-181878

(51) Int. Cl.
*B22F 9/04* (2006.01)
*B22F 9/02* (2006.01)

(52) U.S. Cl.
CPC ..... *B22F 9/04* (2013.01); *B22F 9/026* (2013.01); *B22F 2009/043* (2013.01); *B22F 2201/10* (2013.01); *B22F 2301/054* (2013.01)

(58) Field of Classification Search
CPC ..... B02C 23/34; B02C 23/22; B02C 23/24; B02C 23/18; B02C 15/007
See application file for complete search history.

(56) References Cited

U.S. PATENT DOCUMENTS 834,387 A * 10/1906 Little ..... B02C 15/04 241/80
1,628,609 A * 5/1927 Newhouse ..... F23K 3/00 110/106

(Continued)

FOREIGN PATENT DOCUMENTS

CN 1191776 A 9/1998
CN 1918668 A 2/2007

(Continued)

OTHER PUBLICATIONS

International Search Report dated Nov. 2, 2020, issued in counterpart International Application No. PCT/JP2020/031130 (2 pages).

(Continued)

*Primary Examiner* — Christopher L Templeton
*Assistant Examiner* — P Derek Pressley
(74) *Attorney, Agent, or Firm* — WHDA, LLP

(57) ABSTRACT

A blower (100) blows inert gas. A crusher (200) repeats vitrifying plural kinds of inorganic compounds (A1) by mechanical energy and blowing up the plural kinds of vitrified inorganic compounds (A1) by the inert gas blown from the blower (100). At least some of the plural kinds of inorganic compounds (A1) blown up by the inert gas enter into a first collector (300). The first collector (300) returns the at least some of the plural kinds of inorganic compounds to the crusher (200). A system (S) (for example, a pipe (Pa), a buffer tank (110), a pipe (Pb), a pipe (Pc), and a pipe (Pi) described below) circulates the inert gas from the blower (100) through the crusher (200) and the first collector (300) to the blower (100).

14 Claims, 3 Drawing Sheets

(56) References Cited

U.S. PATENT DOCUMENTS

| | | | | | |
|---|---|---|---|---|---|
| 1,822,999 | A * | 9/1931 | Peters | B02C 15/08 241/49 |
| 2,327,402 | A * | 8/1943 | Clark | B02C 15/08 241/173 |
| 3,606,179 | A * | 9/1971 | Romanowski | B02C 15/007 241/300 |
| 3,854,666 | A * | 12/1974 | Switzer, Jr. | F23K 1/00 241/24.31 |
| 4,887,773 | A * | 12/1989 | Mehltretter | F27D 3/0033 241/176 |
| 6,076,752 | A * | 6/2000 | Paradowski | B02C 23/18 241/31 |
| 6,193,176 | B1 | 2/2001 | Mitsuda et al. | |
| 7,654,396 | B2 | 2/2010 | Takeno et al. | |
| 8,556,197 | B2 | 10/2013 | Hama et al. | |
| 8,962,194 | B2 | 2/2015 | Senga et al. | |
| 10,461,363 | B2 | 10/2019 | Kanno et al. | |
| 11,590,510 | B2 | 2/2023 | Matsumoto et al. | |
| 2003/0122003 | A1* | 7/2003 | Schlesiger | F26B 21/002 241/23 |
| 2007/0160911 | A1 | 7/2007 | Senga et al. | |
| 2007/0228194 | A1* | 10/2007 | Takeno | B07B 7/083 241/24.24 |
| 2011/0108642 | A1 | 5/2011 | Hama et al. | |
| 2013/0082129 | A1* | 4/2013 | Authenrieth | B02C 19/186 241/231 |
| 2013/0146686 | A1* | 6/2013 | Schlegel | B02C 23/34 241/47 |
| 2017/0155168 | A1 | 6/2017 | Kanno et al. | |
| 2018/0209738 | A1* | 7/2018 | Lee | F26B 3/04 |
| 2018/0221889 | A1 | 8/2018 | Matsumoto et al. | |
| 2022/0331813 | A1 | 10/2022 | Yaguchi et al. | |

FOREIGN PATENT DOCUMENTS

| | | | | | |
|---|---|---|---|---|---|
| CN | 105363541 | A | * | 3/2016 | |
| CN | 207243927 | U | | 4/2018 | |
| CN | 108328907 | A | | 7/2018 | |
| EP | 227008 | A | * | 7/1987 | B02C 23/34 |
| EP | 3 984 968 | A1 | | 4/2022 | |
| GB | 351129 | A | | 6/1931 | |
| GB | 1450864 | A | * | 9/1976 | F23K 1/00 |
| GB | 2 281 519 | A | | 3/1995 | |
| JP | S49107002 | A | | 10/1974 | |
| JP | 3-157149 | A | | 7/1991 | |
| JP | H07-100402 | A | | 4/1995 | |
| JP | H10230179 | A | | 9/1998 | |
| JP | 2005-228570 | A | | 8/2005 | |
| JP | 2005-324104 | A | | 11/2005 | |
| JP | 2009-210156 | A | | 9/2009 | |
| JP | 2010-40511 | A | | 2/2010 | |
| JP | 2012254429 | A | * | 12/2012 | |
| JP | 2013-226503 | A | | 11/2013 | |
| JP | 2016-27545 | A | | 2/2016 | |
| JP | 2017-131829 | A | | 8/2017 | |
| JP | 2017-218330 | A | | 12/2017 | |
| JP | 2018-156835 | A | | 10/2018 | |
| JP | 2018-202347 | A | | 12/2018 | |
| KR | 2007-0012474 | A | | 1/2007 | |
| WO | 2020250960 | A1 | | 12/2020 | |

OTHER PUBLICATIONS

Office Action dated Nov. 7, 2022, issued in counterpart CN application No. 202080062128.4. (7 pages).

Office Action dated Apr. 18, 2023, issued in counterpart to KR Application No. 10-2022-7011051, with English Translation. (12 pages).

Office Action dated May 14, 2024, issued in counterpart JP application No. 2023-067010, with English translation. (3 pages).

Extended (Supplementary) European Search Report dated Oct. 24, 2022, issued in counterpart EP application No. 20871660.5. (6 pages).

Office Action dated Feb. 17, 2025, issued in counterpart CN Application No. 202310295787.8. (7 pages).

Office Action dated May 30, 2025, issued in counterpart CN Application No. 202310295787.8. (7 pages).

Decision to Grant, dated Jul. 29, 2025, issued in counterpart CN Application No. 202310295787.8 (4 pages).

* cited by examiner

APPARATUS OF MANUFACTURING INORGANIC MATERIAL AND METHOD OF MANUFACTURING INORGANIC MATERIAL

TECHNICAL FIELD

The present invention relates to an apparatus of manufacturing an inorganic material and a method of manufacturing an inorganic material.

BACKGROUND ART

Recently, as a solid electrolyte material of a lithium battery, a sulfide solid electrolyte material may be used.

Patent Document 1 describes a method of manufacturing a sulfide solid electrolyte material. In this method, lithium sulfide ($Li_2S$) powder, diphosphorus pentasulfide ($P_2S_5$) powder, and red phosphorus (P) powder are mixed with each other in a glove box in an argon atmosphere to obtain a raw material composition. Next, using a planetary ball mill machine, mechanical milling is conducted on the raw material composition to obtain an amorphous ion conductive material. Next, this ion conductive material is heated to obtain a sulfide solid electrolyte material.

RELATED DOCUMENT

Patent Document

[Patent Document 1] Japanese Unexamined Patent Publication No. 2016-27545

SUMMARY OF THE INVENTION

Technical Problem

In the manufacturing of the inorganic material such as a sulfide solid electrolyte material, mechanical milling is conducted on plural kinds of inorganic compounds using a crusher such as a planetary ball mill machine. The mechanical milling may be required to reduce contact between the inorganic compound and air.

One example of the objects of the present invention is to reduce contact between an inorganic compound and air during mechanical milling. Another object of the present invention will be clarified from the description of the present specification.

Solution to Problem

According to one aspect of the present invention, there is provided an apparatus of manufacturing an inorganic material, the apparatus including:

a blower blowing inert gas;

a crusher repeating vitrifying plural kinds of inorganic compounds to be the inorganic material by mechanical energy and blowing up the plural kinds of vitrified inorganic compounds by the inert gas blown from the blower;

a first collector into which at least some of the plural kinds of inorganic compounds blown up by the inert gas enters, the first collector returning the at least some of the plural kinds of inorganic compounds to the crusher; and a system circulating the inert gas from the blower through the crusher and the first collector to the blower.

According to another aspect of the present invention, there is provided a method of manufacturing an inorganic material, the method including:

by a blower, blowing inert gas;

by a crusher, repeating vitrifying plural kinds of inorganic compounds to be the inorganic material by mechanical energy and blowing up the plural kinds of vitrified inorganic compounds by the inert gas blown from the blower;

returning from a first collector to the crusher at least some of the plural kinds of inorganic compounds blown up by the inert gas and entering into the first collector; and circulating the inert gas from the blower through the crusher and the first collector to the blower.

Advantageous Effects of Invention

In the above-described aspects of the present invention, contact between an inorganic compound and air during mechanical milling can be reduced.

DESCRIPTION OF EMBODIMENTS

Figure 1:
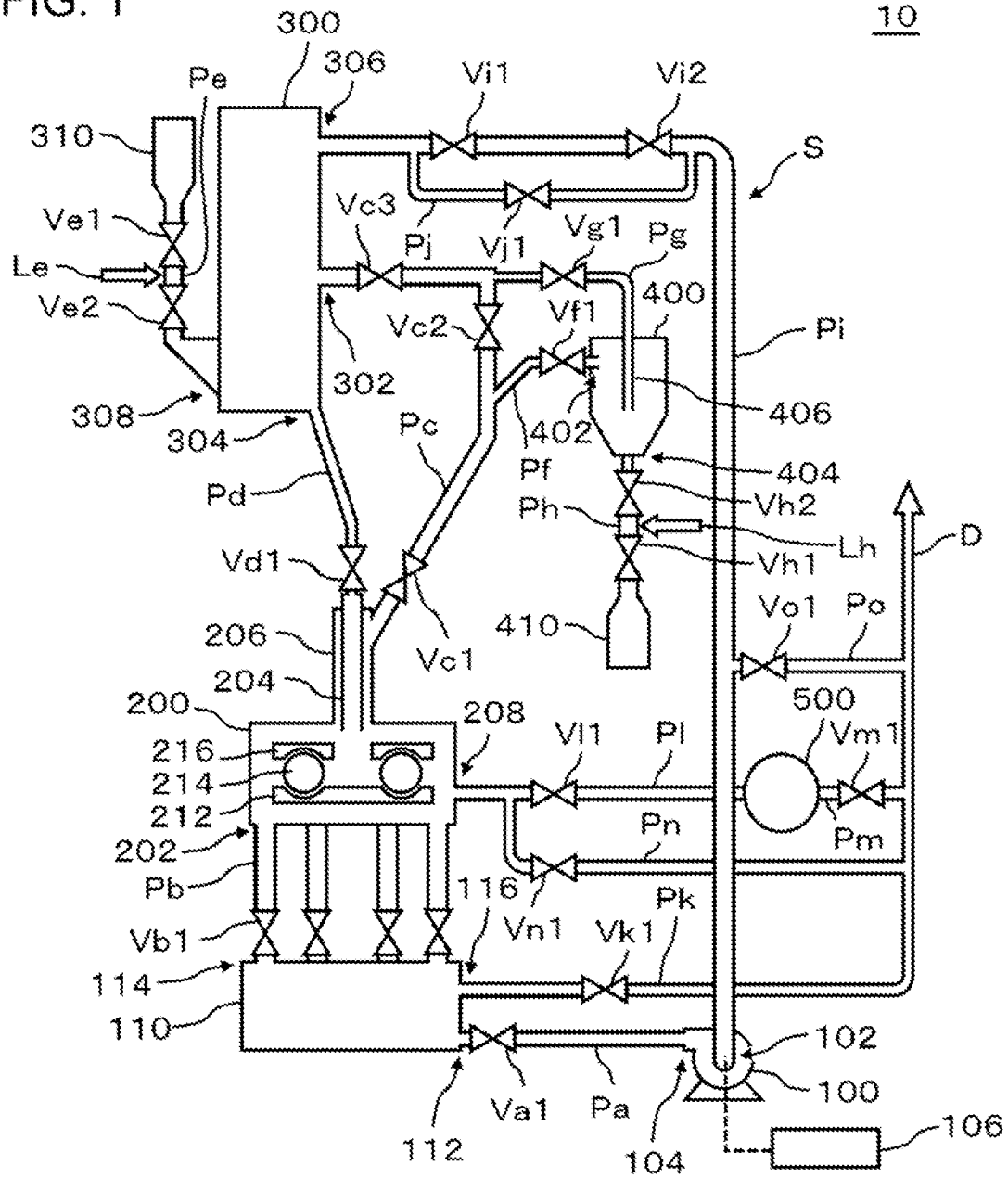
FIG. 1 is a diagram showing an apparatus according to an embodiment.

Hereinafter, an embodiment of the present invention will be described using the drawings. In all of the drawings, the same components will be represented by the same reference numerals, and the description thereof will not be repeated.

Figure 2:
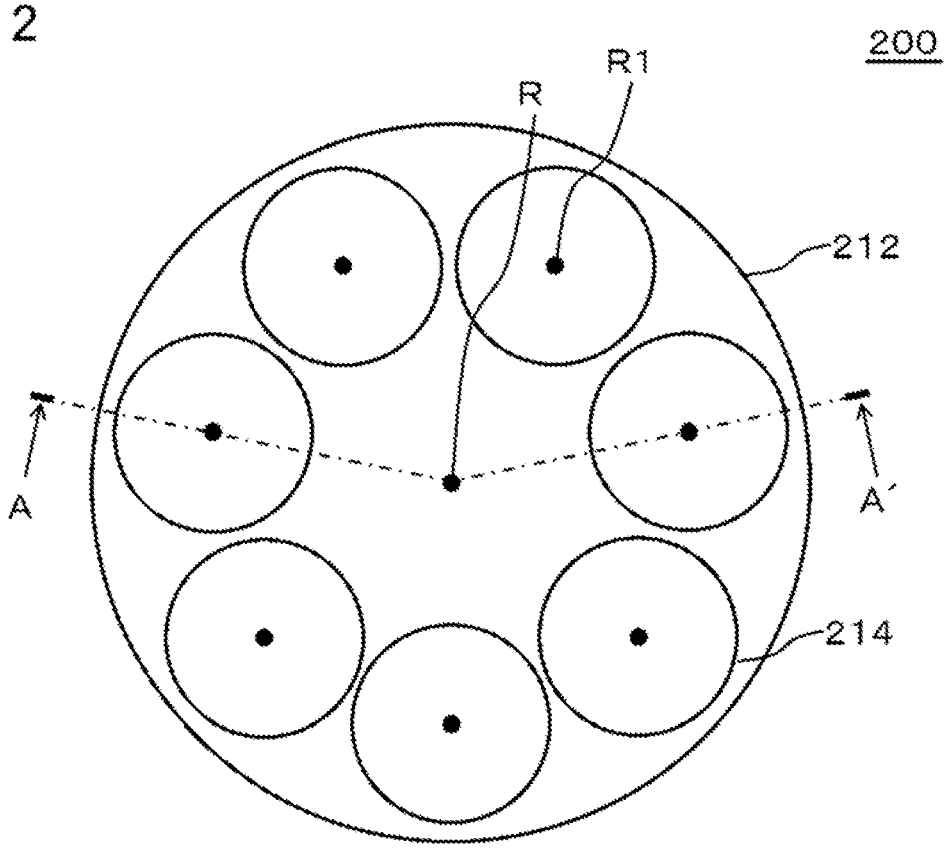
FIG. 2 is a top view showing a rotating table and a plurality of balls of a crusher shown in FIG. 1.
Figure 3:
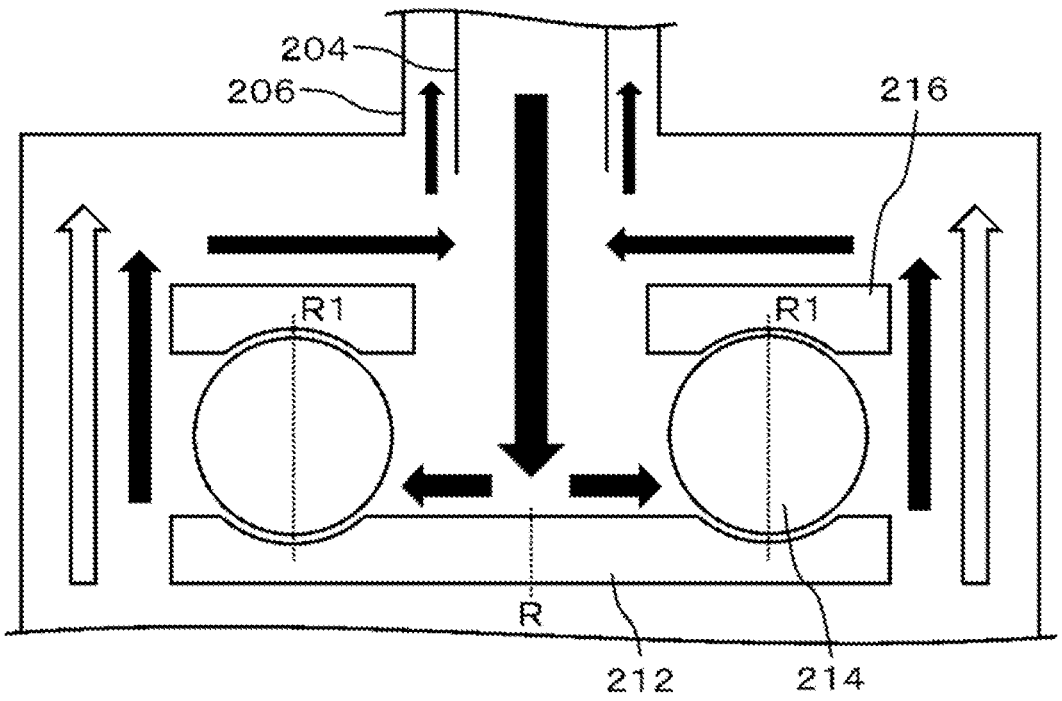
FIG. 3 is a cross-sectional view taken along line A-A' of FIG. 2.

FIG. 1 is a diagram showing an apparatus 10 according to the embodiment. FIG. 2 is a top view showing a rotating table 212 and a plurality of balls 214 of a crusher 200 shown in FIG. 1. FIG. 3 is a cross-sectional view taken along line A-A' of FIG. 2. The apparatus 10 manufactures an inorganic material (A) from plural kinds of inorganic compounds (A1). In FIG. 1, an upward direction of FIG. 1 refers to an upward direction with respect to the vertical direction, and a downward direction of FIG. 1 refers to a downward direction with respect to the vertical direction. For description, FIG. 2 does not show a presser 216. In FIG. 3, a black arrow shows a flow of the plural kinds of inorganic compounds (A1). In FIG. 3, a white arrow shows a flow of inert gas.

The summary of the apparatus 10 will be described using FIG. 1. The apparatus 10 includes a blower 100, a crusher 200, a first collector 300, and a system S. The blower 100 blows inert gas. The crusher 200 repeats vitrifying the plural kinds of inorganic compounds (A1) by mechanical energy and blowing up the plural kinds of vitrified inorganic compounds (A1) by the inert gas blown from the blower 100. At least some of the plural kinds of inorganic compounds (A1) blown up by the inert gas enters into the first collector 300. The first collector 300 returns the at least some of the plural kinds of inorganic compounds (A1) to the crusher 200. The system S (for example, a pipe Pa, a buffer tank 110, a pipe Pb, a pipe Pc, and a pipe Pi described below) circulates the inert gas from the blower 100 through the crusher 200 and the first collector 300 to the blower 100.

A structure of the apparatus 10 will be described using FIG. 1.

The apparatus 10 includes the blower 100, the buffer tank 110, the crusher 200, the first collector 300, a first container 310, a second collector 400, a second container 410, a decompressor 500, the pipe Pa, a plurality of pipes Pb, the pipe Pc (second pipe), a pipe Pd, a pipe Pe (first pipe), a pipe Pf (third pipe), a pipe Pg, a pipe Ph (fourth pipe), the pipe Pi, a pipe Pj, a pipe Pk, a pipe Pl, a pipe Pm, a pipe Pn, a pipe Po, a valve Va1, a plurality of valves Vb1, a valve Vc1, a valve Vc2 (second valve), a valve Vc3, a valve Vd1, a valve Ve1 (first valve), a valve Ve2, a valve Vf1 (third valve), a valve Vg1, a valve Vh1, a valve Vh2, a valve Vi1, a valve Vi2, a valve Vj1, a valve Vk1, a valve Vl1, a valve Vm1, a valve Vn1, a valve vo1, a line Le (first line), a line Lh (second line), and an exhaust duct D.

The pipe Pa communicates to a gas outlet 104 of the blower 100 and a gas inlet 112 of the buffer tank 110. The valve Va1 is provided in the pipe Pa.

Each of the plurality of pipes Pb communicates to each of a plurality of gas outlets 114 of the buffer tank 110 and each of a plurality of gas inlets 202 of the crusher 200. Each of the plurality of valves Vb1 are provided in each of the plurality of pipes Pb. For example, when seen from the top of the rotating table 212 (the details will be described below) of the crusher 200, the plurality of pipes Pb are disposed around the rotating table 212. Specifically, the plurality of pipes Pb are arranged in rotational symmetry about the center (rotation axis R described below) of the rotating table 212.

The pipe Pc communicates to a material discharge pipe 206 of the crusher 200 and a suction port 302 of the first collector 300. The valve Vc1, the valve Vc2, and the valve Vc3 are provided in the pipe Pc and are arranged in this order from the material discharge pipe 206 of the crusher 200 to the suction port 302 of the first collector 300.

The pipe Pd communicates to a material supply pipe 204 of the crusher 200 and a material discharge port 304 of the first collector 300. The valve Vd1 is provided in the pipe Pd.

The pipe Pe communicates to the first container 310 and a material supply port 308 of the first collector 300. The valve Ve1 and the valve Ve2 are provided in the pipe Pe and are arranged in this order from the first container 310 to the material supply port 308 of the first collector 300. The valve Ve1 is detachably attached to the pipe Pe together with the first container 310. In other words, when the valve Ve1 is detached from the pipe Pe, the first container 310 and the valve Ve1 can be integrated. Further, the pipe Pe is connected to the line Le between the valve Ve1 and the valve Ve2. The inside of the pipe Pe can be replaced with a vacuum or inert gas through the line Le. That is, the line Le can reduce the internal pressure of the pipe Pe and can introduce inert gas into the pipe Pe.

The pipe Pf communicates to a portion of the pipe Pc positioned between the valve Vc1 and the valve Vc2 (that is, between the crusher 200 and the valve Vc2), and a suction port 402 of the second collector 400. The valve Vf1 is provided in the pipe Pf.

The pipe Pg communicates to a portion of the pipe Pc positioned between the valve Vc2 and the valve Vc3, and a gas discharge pipe 406 of the second collector 400. The valve Vg1 is provided in the pipe Pg.

The pipe Ph communicates to the second container 410 and a material discharge port 404 of the second collector 400. The valve Vh1 and the valve Vh2 are provided in the pipe Ph and are arranged in this order from the second container 410 to the material discharge port 404 of the second collector 400. Further, the pipe Ph is connected to the line Lh between the valve Vh1 and the valve Vh2. The inside of the pipe Ph can be replaced with a vacuum or inert gas through the line Lh. That is, the line Lh can reduce the internal pressure of the pipe Ph and can introduce inert gas into the pipe Ph.

The pipe Pi communicates to a gas discharge port 306 of the first collector 300 and a gas inlet 102 of the blower 100. The valve Vi1 and the valve Vi2 are provided in the pipe Pi, and are arranged in this order from the gas discharge port 306 of the first collector 300 to the gas inlet 102 of the blower 100.

The pipe Pj is connected to a portion of the pipe Pi positioned between the gas discharge port 306 of the first collector 300 and the valve Vi1 and a portion of the pipe Pi positioned between the gas inlet 102 of the blower 100 and the valve Vi2. The valve Vj1 is provided in the pipe Pj.

The pipe Pk communicates to an adjustment port 116 of the buffer tank 110 and an exhaust duct D. The valve Vk1 is provided in the pipe Pk.

The pipe Pl communicates to a gas discharge port 208 of the crusher 200 and the decompressor 500. The valve Vl1 is provided in the pipe Pl.

The pipe Pm communicates to the decompressor 500 and the exhaust duct D. The valve Vm1 is provided in the pipe Pm.

The pipe Pn communicates a portion of the pipe Pl positioned between the gas discharge port 208 of the crusher 200 and the valve Vl1, and the exhaust duct D. The valve Vn1 is provided in the pipe Pn.

The pipe Po is branched from the pipe Pi and communicates to the exhaust duct D. Specifically, the pipe Pi includes an end portion of the pipe Pj positioned between the valve Vi2 and the gas inlet 102 of the blower 100. The pipe Po communicates to a portion of the pipe Pi positioned between the above-described portion and the gas inlet 102 of the blower 100, and the exhaust duct D. The valve Vo1 is provided in the pipe Po.

The blower 100 sucks gas in the pipe Pj through the gas inlet 102 of the blower 100. The blower 100 discharges, through the gas outlet 104 of the blower 100, the gas sucked through the gas inlet 102 of the blower 100. Thus, the blower 100 sends the gas to the buffer tank 110 through the pipe Pa. The rotation speed of a motor of the blower 100 is changeable by an inverter 106, and the flow rate of the gas sent from the blower 100 is freely changeable depending on the rotation speed of the motor.

The gas sent from the blower 100 through the pipe Pa enters into the gas inlet 112 of the buffer tank 110. The gas in the buffer tank 110 passes through the plurality of gas outlets 114 of the buffer tank 110 and is sent to the crusher 200 through the plurality of pipes Pb. The pressure of the gas in the buffer tank 110 is adjusted by the valve Vk1.

The gas sent from the buffer tank 110 through the plurality of pipes Pb enters into the plurality of gas inlets 202 of the crusher 200. A material sent from the first container 310 through the pipe Pe, the first collector 300, and the pipe Pd enters into the material supply pipe 204 of the crusher 200. At least some of the material and at least some of the gas in the crusher 200 are discharged through the material discharge pipe 206 of the crusher 200. The internal pressure of the crusher 200 can be reduced by the decompressor 500. The gas in the crusher 200 can be discharged to the exhaust duct D through the pipe Pn.

The first collector 300 sucks the material and the gas in the pipe Pc through the suction port 302 of the first collector 300. The first collector 300 discharges the material sucked through the suction port 302 of the first collector 300 through the material discharge port 304 of the first collector 300. Thus, the first collector 300 sends the material to the crusher 200 through the pipe Pd. The first collector 300 discharges the gas sucked through the suction port 302 of the first collector 300 through the gas discharge port 306 of the first collector 300. Thus, the first collector 300 sends the gas to the blower 100 through the pipe Pi. The first collector 300 is, for example, a dust collector.

The second collector 400 sucks the material and the gas in the pipe Pc and the pipe Pf through the suction port 402 of the second collector 400. The second collector 400 discharges the material sucked through the suction port 402 of the second collector 400 through the material discharge port 404 of the second collector 400. Thus, the second collector 400 sends the material to the second container 410 through the pipe Ph. The second collector 400 discharges the gas sucked through the suction port 402 of the second collector 400 through the gas discharge pipe 406 of the second collector 400. The second collector 400 is, for example, a cyclone dust collector.

Next, a structure of the crusher 200 will be described using FIGS. 2 and 3.

The crusher 200 includes the rotating table 212, the plurality of balls 214, and the presser 216. In the example shown in FIG. 2, the number of the plurality of balls 214 is seven. However, the number of the plurality of balls 214 is not limited to the example shown in FIG. 2.

The rotating table 212 is rotatable about the rotation axis R. The rotation axis R of the rotating table 212 passes through the center of the rotating table 212 in a height direction (thickness direction) of the rotating table 212. The height direction (thickness direction) of the rotating table 212 is along the vertical direction. The plurality of balls 214 are arranged around the rotation axis R of the rotating table 212. Specifically, the plurality of balls 214 are arranged in rotational symmetry about the rotation axis R. The plurality of balls 214 rotate together with the rotation of the rotating table 212. Each of the plurality of balls 214 is individually rotatable about rotation axis R1 rotating together with the rotation of the rotating table 212. The rotation axis R1 of each ball 214 passes through the center of the ball 214 in the height direction (thickness direction) of the ball 214. The height direction (thickness direction) of the ball 214 is along the vertical direction. The presser 216 presses the plurality of balls 214 to the rotating table 212 from a side opposite to the rotating table 212.

Next, an example of a method of manufacturing the inorganic material (A) from the plural kinds of inorganic compounds (A1) using the apparatus 10 will be described using FIGS. 1 to 3.

The valve Ve1 and the valve Ve2 are closed, and the plural kinds of inorganic compounds (A1) are contained in the first container 310. Specifically, first, the first container 310 is detached from the pipe Pe together with the valve Ve1. Next, the plural kinds of inorganic compounds (A1) are contained in the first container 310. The containing of the plural kinds of inorganic compounds (A1) is implemented in an atmosphere (for example, in a glove box) controlled by the inert gas. Next, the first container 310 and the valve Ve1 are attached to the pipe Pe with the valve Ve1 being closed. In this case, even if the first container 310 and the valve Ve1 are exposed to the atmosphere, the closed valve Ve1 can prevent the plural kinds of inorganic compounds (A1) in the first container 310 from being exposed to the atmosphere (air). When the first container 310 is attached, the atmosphere in the pipe Pe can be replaced with the inert gas through the line Le connected to the pipe Pe. Thus, when the inorganic compounds (A1) pass through the pipe Pe, the inorganic compounds (A1) can be prevented from being exposed to the atmosphere (air). Next, the valve Ve1, the valve Ve2, and the valve Vd1 are opened, and the plural kinds of inorganic compounds (A1) are sent from the first container 310 to the crusher 200 through the pipe Pe, the first collector 300, and the pipe Pd. That is, the first container 310 contains the plural kinds of inorganic compounds (A1) supplied to the crusher 200.

Further, the valve Ve1, the valve Ve2, the valve Vf1, the valve Vg1, the valve Vh1, the valve Vh2, the valve Vj1, the valve Vl1, the valve Vm1, the valve Vn1, and the valve vo1 are closed, and the valve Va1, the valves Vb1, the valve Vc1, the valve Vc2, the valve Vc3, the valve Vd1, the valve Vi1, and the valve Vi2 are opened, and the inert gas is supplied to a portion of the pipe Pi positioned between the valve Vi1 and the valve Vi2. Next, the blower 100 is operated while adjusting the internal pressure of the buffer tank 110 using the valve Vk1. Thus, the system S, that is, the system from the blower 100 through the pipe Pa, the buffer tank 110, the pipe Pb, the crusher 200, the pipe Pc, the first collector 300, and the pipe Pi to the blower 100 circulates the inert gas and is closed from the outside (that is, the system S is not exposed to the atmosphere (air)).

The supply of the inert gas to the portion of the pipe Pi positioned between the valve Vi1 and the valve Vi2 may be conducted before or after supplying the plural kinds of inorganic compounds (A1) from the first container 310 to the crusher 200 or may be conducted while supplying the plural kinds of inorganic compounds (A1) from the first container 310 to the crusher 200. The position where the inert gas is supplied does not need to be the portion of the pipe Pi positioned between the valve Vi1 and the valve Vi2 and may be any portion in the system S. The inert gas may be supplied to a plurality of portions in the system S (including the portion of the pipe Pi positioned between the valve Vi1 and the valve Vi2).

In the present embodiment, the inert gas is nitrogen gas. The nitrogen gas is supplied, for example, from a nitrogen gas container through a nitrogen purifier. In this example, the impurity concentration (for example, the water concentration or the oxygen concentration) in the nitrogen gas can be reduced. For example, the water concentration in the nitrogen gas may be 400 ppm or less, preferably 40 ppm or less, and more preferably 2 ppm or less, and the oxygen concentration in the nitrogen gas may be 400 ppm or less, preferably 40 ppm or less, and more preferably 2 ppm or less. The inert gas may be, however, gas other than nitrogen gas, such as argon gas.

Further, the crusher 200 is operated. Specifically, the rotating table 212 is rotated about the rotation axis R, each of the balls 214 is rotated about the rotation axis R1, and the plurality of balls 214 are pressed to the rotating table 212 by the presser 216. The operation of the crusher 200 may start before or after supplying the plural kinds of inorganic compounds (A1) from the first container 310 to the crusher 200 or may start while supplying the plural kinds of inorganic compounds (A1) from the first container 310 to the crusher 200. The crusher 200 repeats vitrifying the plural kinds of inorganic compounds (A1) using mechanical energy and blowing up the plural kinds of vitrified inorganic compounds (A1) by the inert gas blown from the blower 100, as below.

First, as indicated by the black arrow extending from the material supply pipe 204 to the rotating table 212 in FIG. 3, the plural kinds of inorganic compounds (A1) supplied from the first container 310 arrive at the center of the rotating table 212 or the periphery thereof (the rotation axis R and the periphery thereof) through the material supply pipe 204.

Next, as indicated by two black arrows extending from the periphery of the center (rotation axis R) of the rotating table 212 to both sides in FIG. 3, The plural kinds of inorganic compounds (A1) move from the center (rotation axis R) of the rotating table 212 to the balls 214 due to a centrifugal force generated by the rotation of the rotating table 212, and enters into a gap between the rotating table 212 and the balls 214. The plural kinds of inorganic compounds (A1) in the gap between the rotating table 212 and the balls 214 are vitrified by mechanical energy. Specifically, shearing stress and compressive stress are applied to the plural kinds of inorganic compounds (A1) in the gap between the rotating table 212 and the balls 214 due to the rotation of the balls 214 and the press of the balls 214 to the rotating table 212 by the presser 216. The plural kinds of inorganic compounds (A1) are vitrified by the shearing stress and the compressive stress. That is, mechanical milling is conducted on the plural kinds of inorganic compounds (A1).

As indicated by two white arrows positioned on both sides of the rotating table 212, the plurality of balls 214, and the presser 216 in FIG. 3, the inert gas flows from the lower side to the upper side of the crusher 200 outside of the rotating table 212. This flow is generated by the inert gas sent from the blower 100 through the gas inlets 202 of the crusher 200. As indicated by two black arrows positioned on both sides of the plurality of balls 214 and the presser 216 in FIG. 3, the plural kinds of vitrified inorganic compounds (A1) are blown up by the inert gas. At this time, the rotation speed of the motor of the blower 100 is reduced by the inverter 106. Thus, the flow rate of the inert gas sent from the blower 100 to the crusher 200 is reduced, and the inorganic compounds (A1) are prevented from exiting from the material discharge pipe 206.

As indicated by two black arrows extending from the outside of the rotating table 212 to the center of the rotating table 212 on the presser 216 in FIG. 3, some of the plural kinds of inorganic compounds (A1) blown up by the inert gas moves from the outside of the rotating table 212 to the center of the rotating table 212 above the presser 216. As in the plural kinds of inorganic compounds (A1) supplied from the material supply pipe 204, the plural kinds of inorganic compounds (A1) arrive at the center of the rotating table 212 or the periphery thereof (the rotation axis R and the periphery thereof). Then, mechanical milling is conducted on the plural kinds of inorganic compounds (A1) in the same manner as that described above.

As indicated by two black arrows extending to the upper side of the presser 216 above the presser 216 in FIG. 3, some other of the plural kinds of inorganic compounds (A1) blown up by the inert gas may enter into the material discharge pipe 206 without returning to the rotating table 212. For example, the plural kinds of inorganic compounds (A1) having a small particle size are likely to enter into the material discharge pipe 206 without returning to the rotating table 212. The plural kinds of inorganic compounds (A1) in the material discharge pipe 206 are sent to the first collector 300 through the pipe Pc, are sent from the first collector 300 to the material supply pipe 204 of the crusher 200 through the pipe Pd, and return to the rotating table 212. Accordingly, mechanical milling by the crusher 200 can be conducted on even the plural kinds of inorganic compounds (A1) in the material discharge pipe 206.

While conducting mechanical milling of the crusher 200, as described above, the system S, that is the system from the blower 100 through the pipe Pa, the buffer tank 110, the pipe Pb, the crusher 200, the pipe Pc, the first collector 300, and the pipe Pi to the blower 100 circulates the inert gas and is closed from the outside. Accordingly, contact between the plural kinds of inorganic compounds (A1) and air can be reduced.

By conducting mechanical milling on the plural kinds of inorganic compounds (A1) by the crusher 200, the plural kinds of inorganic compounds (A1) are vitrified, and the inorganic material (A) is manufactured from the plural kinds of inorganic compounds (A1).

Next, an example of a method of removing the inorganic material (A) from the apparatus 10 will be described.

The valve Vc2 is closed, the valve Vf1 and the valve Vg1 are opened, and the inverter 106 connected to the motor of the blower 100 is controlled to increase the rotation speed of the motor of the blower 100, and the flow rate of the inert gas sent to the gas inlets 202 of the crusher 200 increases (at this stage, the valve Vh1 and the valve Vh2 are closed). By increasing the flow rate of the inert gas sent to the gas inlets 202 of the crusher 200, the inorganic material (A) blown up by the inert gas in the crusher 200 is sent into the material discharge pipe 206 without substantially or completely returning to the rotating table 212. The inorganic material (A) sent into the material discharge pipe 206 enters into the suction port 402 of the second collector 400 through the pipe Pc and the pipe Pf. Thus, the inorganic material (A) is collected by the second collector 400. Next, the valve Vh1 and the valve Vh2 are opened. Thus, the inorganic material (A) collected by the second collector 400 enters into the second container 410 through the pipe Ph. Next, the valve Vh1 and the valve Vh2 are closed. Next, the second container 410 is detached from the pipe Ph. In this case, the inside of the pipe Ph can be prevented from being exposed to the atmosphere (air) by the closed valve Vh1 and valve Vh2. When the second container 410 is attached to the pipe Ph again, the atmosphere in the pipe Ph can be replaced with the inert gas through the line Lh connected to the pipe Ph. Thus, when the inorganic material (A) passes through the pipe Ph, the inorganic material (A) can be prevented from being exposed to the atmosphere (air).

Next, an example of the operation of the decompressor 500 will be described.

The inside of the crusher 200 may be exposed to the atmosphere (air), for example, when an internal component (for example, the rotating table 212, the balls 214, or the presser 216) of the crusher 200 is cleaned. In this case, the air in the crusher 200 can be removed by reducing the internal pressure of the crusher 200 using the decompressor 500. For example, the decompressor 500 can be operated with the plurality of valves Vb1, the valve Vc1, the valve Vd1, and the valve Vn1 closed, and with the valve Vl1 and the valve Vm1 opened.

By heating the inorganic material (A), an inorganic material (B) having improved crystallinity can be formed. The inorganic material (B) is not particularly limited, and examples thereof include an inorganic solid electrolyte material, a positive electrode active material, a negative electrode active material, and the like.

The inorganic solid electrolyte material is not particularly limited, and examples thereof include a sulfide-based inorganic solid electrolyte material, an oxide-based inorganic solid electrolyte material, and other lithium-based inorganic solid electrolyte materials. Among these, a sulfide-based inorganic solid electrolyte material is preferable. The inorganic solid electrolyte material is not particularly limited, and examples thereof include an inorganic solid electrolyte material used for a solid electrolyte layer forming an all-solid-state lithium ion battery.

Examples of the sulfide-based inorganic solid electrolyte material include a $Li_2S$—$P_2S_5$ material, a $Li_2S$—$SiS_2$ material, a $Li_2S$—$GeS_2$ material, a $Li_2S$—$Al_2S_3$ material, a $Li_2S$—$SiS_2$—$Li_3PO_4$ material, a $Li_2S$—$P_2S_5$—$GeS_2$ material, a $Li_2S$—$Li_2O$—$P_2S_5$—$SiS_2$ material, a $Li_2S$—$GeS_2$—$P_2S_5$—$SiS_2$ material, a $Li_2S$—$SnS_2$—$P_2S_5$—$SiS_2$ material, a $Li_2S$—$P_2S_5$—$Li_3N$ material, a $Li_2S_{2+x}$—$P_4S_3$ material, a $Li_2S$—$P_2S_5$—$P_4S_3$ material, and the like. Among these, the $Li_2S$—$P_2S_5$ material and the $Li_2S$—$P_2S_5$—$Li_3N$ material are preferable from the viewpoint that they have excellent lithium ionic conductivity and has stability to the extent that decomposition or the like does not occur in a wide voltage range. Here, for example, the $Li_2S$—$P_2S_5$ material refers to an inorganic material obtained by a chemical reaction of an inorganic composition including at least $Li_2S$ (lithium sulfide) and $P_2S_5$ by mechanical energy, and the $Li_2S$—$P_2S_5$—$Li_3N$ material refers to an inorganic material obtained by a chemical reaction of an inorganic composition including at least $Li_2S$ (lithium sulfide), $P_{2S}$s, and $Li_3N$ by mechanical energy. Here, in the present embodiment, examples of the lithium sulfide include lithium polysulfide.

Examples of the oxide-based inorganic solid electrolyte material include: a NASICON type such as $LiTi_2(PO_4)_3$, $LiZr_2(PO_4)_3$, or $LiGe_2$ $(PO_4)_3$, a perovskite type such as $(La_{0.5+x}Li_{0.5+3x})TiO_3$; a $Li_2O$—$P_2O_5$ material; a $Li_2O$—$P_2O_5$—$Li_3N$ material; and the like.

Examples of the other lithium-based inorganic solid electrolyte material include LiPON, $LiNbO_3$, $LiTaO_3$, $Li_3PO_4$, $LiPO_{4-x}$ $N_x$ (x satisfies $0<x\leq1$), LiN, LiI, LISICON, and the like. A glass ceramic obtained by precipitating crystal of the inorganic solid electrolytes may also be used as the inorganic solid electrolyte material.

The sulfide-based inorganic solid electrolyte material includes Li, P, and S as constituent elements. From the viewpoint of further improving the lithium ionic conductivity, the electrochemical stability, the stability and the handling properties in water or air, and the like, a molar ratio (Li/P) of the content of Li to the content of P in the solid electrolyte material is preferably 1.0 or higher and 10.0 or lower, more preferably 2.0 or higher and 5.0 or lower, still more preferably 2.5 or higher and 4.0 or lower, still more preferably 2.8 or higher and 3.6 or lower, still more preferably 3.0 or higher and 3.5 or lower, still more preferably 3.1 or higher and 3.4 or lower, and still more preferably 3.1 or higher and 3.3 or lower. A molar ratio (S/P) of the content of S to the content of P is preferably 1.0 or higher and 10.0 or lower, more preferably 2.0 or higher and 6.0 or lower, more preferably 3.0 or higher and 5.0 or lower, still more preferably 3.5 or higher and 4.5 or lower, still more preferably 3.8 or higher and 4.2 or lower, still more preferably 3.9 or higher and 4.1 or lower, and still more preferably 4.0. Here, the contents of Li, P, and S in the solid electrolyte material can be obtained, for example, by ICP optical emission spectroscopy or X-ray photoelectron spectroscopy.

Examples of the shape of the sulfide-based inorganic solid electrolyte material include a particle shape. The inorganic solid electrolyte material having a particle shape is not particularly limited, and an average particle size $d_{50}$ in a weight-based particle size distribution measured using a laser-diffraction scattering method particle size distribution measurement is preferably 1 μm or more and 100 μm or less, more preferably 3 μm or more and 80 μm or less, still more preferably 5 μm or more and 60 μm or less. When the average particle size $d_{50}$ of the inorganic solid electrolyte material is in the above-described range, the lithium ionic conductivity of the obtained solid electrolyte membrane can be further improved while maintaining excellent handling properties.

The positive electrode active material is not particularly limited, and examples thereof include a positive electrode active material that can be used for a positive electrode layer of a lithium ion battery. Examples of the positive electrode active material include a composite oxide such as a lithium cobalt oxide ($LiCoO_2$), a lithium nickel oxide ($LiNiO_2$), a lithium manganese oxide ($LiMn_2O_4$), a solid solution oxide ($Li_2MnO_3$-$LiMO_2$ (M=Co, Ni, or the like)), lithium-manganese-nickel oxide ($LiNi_{1/3}Mn_{1/3}Co_{1/3}O_2$), or an olivine-type lithium phosphorus oxide ($LiFePO_4$); a sulfide-based positive electrode active material such as CuS, a Li—Cu—S compound, $TiS_2$, FeS, $MoS_2$, $V_2S_5$, a Li—Mo—S compound, a Li—Ti—S compound, a Li-V-S compound, or a Li—Fe—S compound; and the like. Among these, from the viewpoints of higher discharge capacity density and higher cycle characteristics, a sulfide-based positive electrode active material is preferable, and a Li—Mo—S compound, a Li—Ti—S compound, or a Li-V-S compound is more preferable. Here, the Li—Mo—S compound includes Li, Mo, and S as constituent elements and can be typically obtained by a chemical reaction of an inorganic composition including molybdenum sulfide and lithium sulfide as raw materials by mechanical energy. The Li—Ti—S compound includes Li, Ti, and S as constituent elements and can be typically obtained by a chemical reaction of an inorganic composition including titanium sulfide and lithium sulfide as raw materials by mechanical energy. The Li-V-S compound includes Li, V, and S as constituent elements and can be typically obtained by a chemical reaction of an inorganic composition including vanadium sulfide and lithium sulfide as raw materials by mechanical energy.

The negative electrode active material is not particularly limited, and examples thereof include a negative electrode active material that can be used for a negative electrode layer of a lithium ion battery. Examples of the negative electrode active material include: a metal material mainly formed of a lithium alloy, a tin alloy, a silicon alloy, a gallium alloy, an indium alloy, or an aluminum alloy; a lithium titanium composite oxide (for example, $Li_4Ti_5O_{12}$), a graphite material, and the like.

Examples of the plural kinds of inorganic compounds (A1) include a material to be the inorganic material (B) by mechanical milling and heating. For example, the plural kinds of inorganic compounds (A1) include Li.

Figure 4:
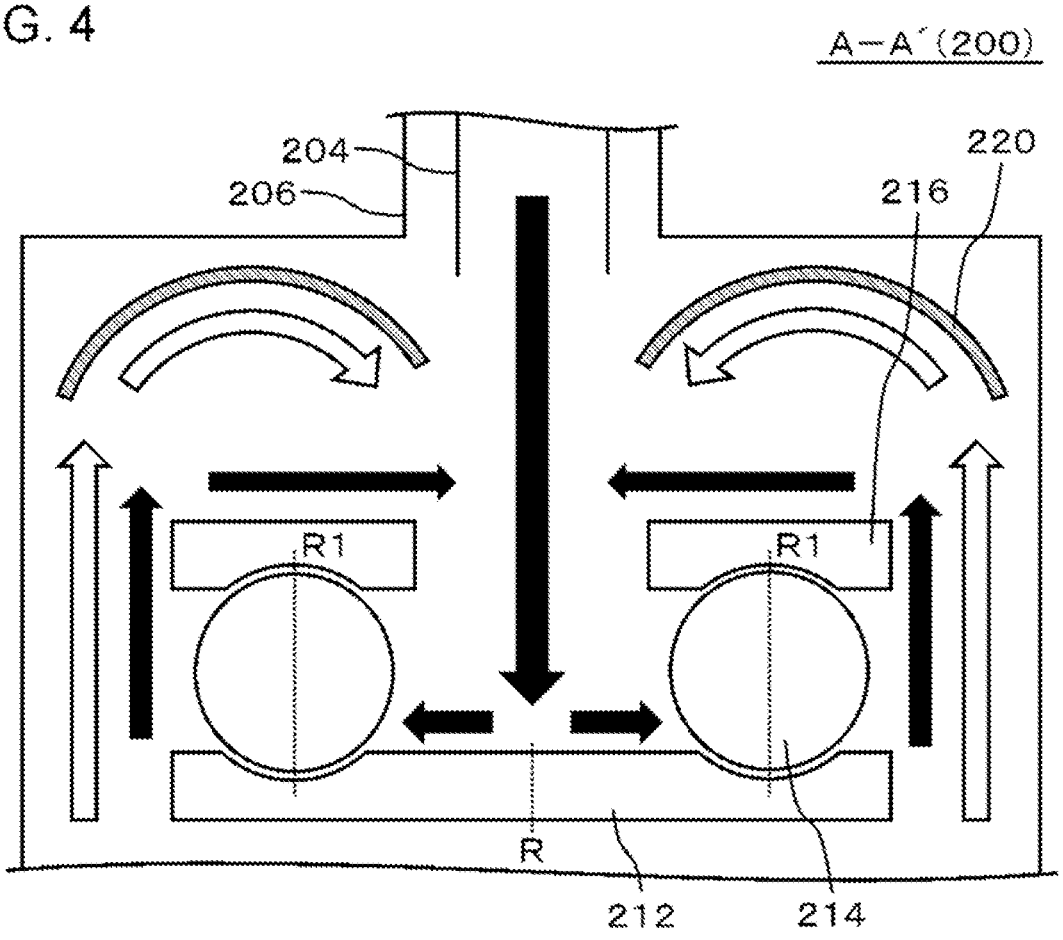
FIG. 4 is a diagram showing a modification example of FIG. 3.

FIG. 4 is a diagram showing a modification example of FIG. 3.

The crusher 200 further includes a cover portion 220. The cover portion 220 is positioned above the presser 216. As indicated by white arrows extending along the cover portion 220 in FIG. 4, the cover portion 220 directs the flow of the inert gas blowing up the plural kinds of inorganic compounds (A1), to the center of the crusher 200 (the rotation axis R of the rotating table 212) and a downward direction of the crusher 200. In this case, as compared to when the cover portion 220 is not provided, the amount of the plural kinds of inorganic compounds (A1) blown up by the inert gas to enter into the material discharge pipe 206 can be reduced, and the amount of the plural kinds of inorganic compounds (A1) blown up by the inert gas to return to the rotating table 212 can be increased. Accordingly, as compared to when the cover portion 220 is not provided, the efficiency of mechanical milling of the crusher 200 can be improved.

Hereinafter, the embodiment of the present invention has been described with reference to the drawings. However, the embodiment is merely an example of the present invention, and various configurations other than the above-described configurations may also be adopted.

For example, in the present embodiment, the crusher 200 presses the balls 214 against the rotating table 212 with the presser 216. The presser 216, however, may press rollers against the rotating table 212 instead of the balls 214. Even in this case, the crusher 200 can conduct mechanical milling on the plural kinds of inorganic compounds (A1).

The present application claims priority based on Japanese Patent Application No. 2019-181878 filed on Oct. 2, 2019, the entire content of which is incorporated herein by reference.

REFERENCE SIGNS LIST

10: apparatus
100: blower
102: gas inlet
104: gas outlet
106: inverter
110: buffer tank
112: gas inlet
114: gas outlet
116: adjustment port
200: crusher
202: gas inlet
204: material supply pipe
206: material discharge pipe
208: gas discharge port
212: rotating table
214: ball
216: presser
220: cover portion
300: first collector
302: suction port
304: material discharge port
306: gas discharge port
308: material supply port
310: first container
400: second collector
402: suction port
404: material discharge port
406: gas discharge pipe
410: second container
500: decompressor
D: exhaust duct
Le: line
Lh: line
Pa: pipe
Pb: pipe
Pc: pipe
Pd: pipe
Pe: pipe
Pf: pipe
Pg: pipe
Ph: pipe
Pi: pipe
Pj: pipe
Pk: pipe
Pl: pipe
Pm: pipe
Pn: pipe
Po: pipe
S: system
Va1: valve
Vb1: valve
Vc1: valve
Vc2: valve
Vc3: valve
Vd1: valve
Ve1: valve
Ve2: valve
Vf1: valve
Vg1: valve
Vh1: valve
Vh2: valve
Vi1: valve
Vi2: valve
Vj1: valve
Vk1: valve
Vl1: valve
Vm1: valve
Vn1: valve
Vo1: valve

The invention claimed is:

1. An apparatus of manufacturing an inorganic material, the apparatus comprising:

a blower blowing inert gas;

a crusher vitrifying plural kinds of inorganic compounds to be the inorganic material, by applying shearing stress and compressive stress to the plural kinds of inorganic compounds, and blowing up the plural kinds of vitrified inorganic compounds by the inert gas blown from the blower;

a first collector into which at least some of the plural kinds of inorganic compounds blown up by the inert gas enters, the first collector returning the at least some of the plural kinds of inorganic compounds to the crusher;

a system circulating the inert gas from the blower through the crusher and the first collector to the blower;

a first container containing the plural kinds of inorganic compounds to be supplied to the crusher;

a first pipe connected to the first collector and the first container, one opening of the first pipe being located at a material supply port of the first collector and another opening of the first pipe being located at an opening of the first container;

a first valve detachably attached to the first pipe with the first container;

a first line introducing inert gas into the first pipe; and a fourth valve provided on the first pipe, a second collector into which the inorganic material blown up by the inert gas enters;

a second pipe communicating to the crusher and the first collector, one opening of the second pipe being located at an opening of a material discharge pipe of the crusher and another opening of the second pipe being located at a suction port of the first collector;

a second valve provided in the second pipe;

a third pipe communicating to the second collector and a portion of the second pipe positioned between the crusher and the second valve, one opening of the third pipe and the second valve being arranged in this order along the second pipe from the opening of the material discharge pipe of the crusher to the suction port of the first collector, and another opening of the third pipe being located at a suction port of the second collector; and a third valve provided in the third pipe, wherein the system is closed from outside of the system, wherein the first valve and the fourth valve are arranged in this order from the first container to the material supply port of the first collector, and wherein the first pipe is connected to the first line between the first valve and the fourth valve.

2. The apparatus according to claim 1, further comprising:

a second container containing the inorganic material collected by the second collector;

a fourth pipe communicating to the second collector and the second container; and a second line introducing inert gas into the fourth pipe.

3. The apparatus according to claim 1, further comprising:

a decompressor reducing an internal pressure of the crusher.

4. The apparatus according to claim 1, wherein the crusher comprises a rotating table, a plurality of balls, and a presser, the plurality of balls being arranged around a rotation axis of the rotating table, each of the plurality of balls being rotatable about a rotation axis rotating together with the rotation of the rotating table, the presser pressing the plurality of balls to the rotating table from a side opposite to the rotating table.

5. The apparatus according to claim 4, wherein the crusher vitrifying the plural kinds of inorganic compounds supplied to a center of the rotating table by applying the shearing stress and the compressive stress to the plural kinds of inorganic compounds, wherein a plurality of gas inlets are positioned around the rotating table so that the inert gas flows from lower side to upper side of the crusher outside of the rotating table, wherein some other of the plural kinds of inorganic compounds blown up by the inert gas moves from outside of the rotating table to the center of the rotating table above the presser.

6. The apparatus according to claim 1, wherein the crusher comprises a cover portion directing a flow of the inert gas blowing up the plural kinds of inorganic compounds, to a center of the crusher and a downward direction of the crusher.

7. The apparatus according to claim 1, wherein the plural kinds of inorganic compounds comprise Li.

8. The apparatus according to claim 1, further comprising a buffer tank, wherein the system circulates the inert gas further through the buffer tank.

9. The apparatus according to claim 8, wherein the inert gas enters the buffer tank, passes through a plurality of gas outlets of the buffer tank and is sent to a plurality of gas inlets of the crusher.

10. The apparatus according to claim 1, further comprising a fifth pipe, wherein the system circulates the inert gas further through the fifth pipe, and the blower sucks the inert gas in the fifth pipe and discharges, through a gas outlet of the blower, the sucked inert gas.

11. The apparatus according to claim 1, wherein a flow rate of the inert gas sent from the blower is changeable.

12. The apparatus according to claim 1, wherein the first collector is a dust collector.

13. The apparatus according to claim 1, further comprising:

a sixth pipe communicating to a gas discharge pipe of the second collector and a portion of the second pipe positioned between the second valve and the first collector, wherein the second valve and one opening of the sixth pipe are arranged in this order along the second pipe from the opening of the material discharge pipe of the crusher to the suction port of the first collector.

14. A method of manufacturing an inorganic material by using the apparatus according to claim 1, the method comprising:

by the blower, blowing the inert gas;

by the crusher, vitrifying the plural kinds of inorganic compounds to be the inorganic material, by applying shearing stress and compressive stress to the plural kinds of inorganic compounds, and blowing up the plural kinds of vitrified inorganic compounds by the inert gas blown from the blower;

returning from the first collector to the crusher at least some of the plural kinds of inorganic compounds blown up by the inert gas and entering into the first collector; and circulating the inert gas from the blower through the crusher and the first collector to the blower in the system.

* * * * *